US005222113A

United States Patent [19]

Thieme et al.

[11] Patent Number: 5,222,113

[45] Date of Patent: Jun. 22, 1993

[54] X-RAY MICROSCOPE

[75] Inventors: Jürgen Thieme, Diemarden; Bastian Nieman; Günter Schmahl, both of Göttingen; Dietbert Rudolph, Nordheim, all of Fed. Rep. of Germany

[73] Assignee: Carl-Zeiss-Stiftung, Heidenheim

[21] Appl. No.: 751,792

[22] Filed: Aug. 29, 1991

[30] Foreign Application Priority Data

Aug. 29, 1990 [DE] Fed. Rep. of Germany ..... 4027285

[51] Int. Cl.[5] ..... G21K 7/00

[52] U.S. Cl. ..... 378/43; 378/84

[58] Field of Search ..... 378/43, 1, 62, 45, 122, 378/206, 99, 84, 85; 280/305, 306, 361 R, 368

[56] References Cited

U.S. PATENT DOCUMENTS

| | | | |
|---|---|---|---|
| 4,596,030 | 6/1986 | Herziger et al. | 378/119 |
| 4,870,674 | 9/1989 | Schmahl et al. | 378/43 |
| 4,912,737 | 3/1990 | Ohsuka et al. | 378/43 |
| 5,132,994 | 7/1992 | Kato | 378/43 |

FOREIGN PATENT DOCUMENTS

| | | |
|---|---|---|
| 0459833 | 12/1991 | European Pat. Off. . |
| 3-71100 | 8/1989 | Japan . |
| WO87/00644 | 1/1987 | World Int. Prop. O. . |

OTHER PUBLICATIONS

"The Göttingen X-Ray Microscope and X-Ray Microscopy Experiments at the BESSY Storage Ring", by D. Rudolph, B. Nieman, G. Schmahl and O. Christ, pp. 192 to 202 from X-Ray Microscopy, vol. 43, (1984), published by Springer.

*Primary Examiner*—David P. Porta
*Assistant Examiner*—Kim-Kuok Chu
*Attorney, Agent, or Firm*—Walter Ottesen

[57] ABSTRACT

The invention is directed to an X-ray microscope having a pulsed X-ray radiation source which supplies an intensive line radiation such as a plasma focus source. The microscope includes a reflecting condenser which focusses the radiation of the radiation source on the specimen to be investigated and an X-ray optic configured as a zone plate. With the zone plate, the specimen is imaged on an X-ray detector with a high resolution. The above combination of elements makes it possible to free an adequately high amount of X-ray energy at the location of the specimen while providing a high resolution free of image errors so that the required short exposure times are provided for the investigation of living cells.

11 Claims, 1 Drawing Sheet

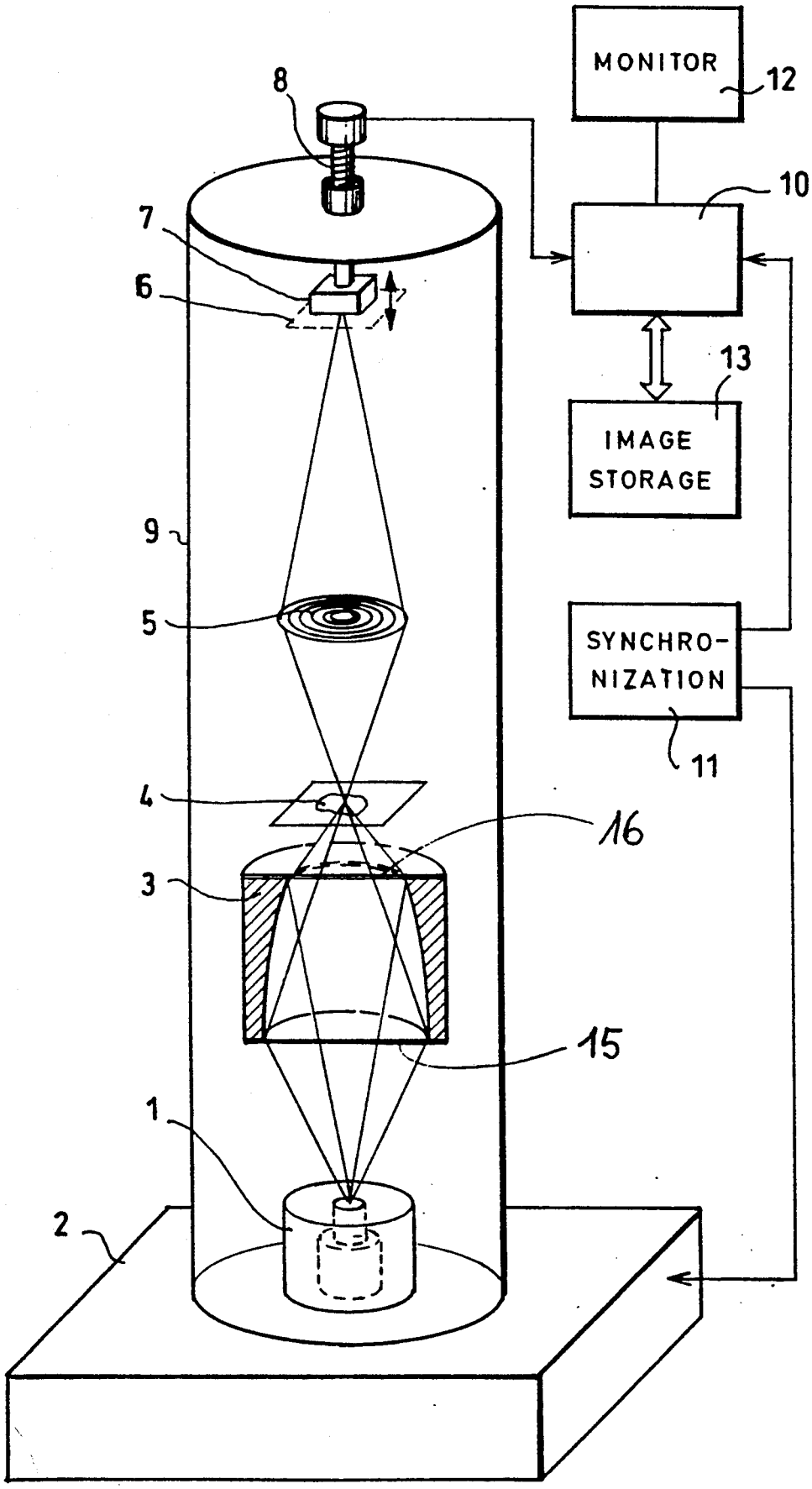
MONITOR
12
8
10
7
6
13
IMAGE
STORAGE
9
5
SYNCHRO-
NIZATION
11
4
16
3
15
1
2

X-RAY MICROSCOPE

BACKGROUND OF THE INVENTION

Various kinds of X-ray microscopes are known which differ more or less with respect to the following: the optical configuration with respect to the beam source used, the optics for focussing the X-ray beam on the specimen to be investigated and the optics for imaging the specimen on the X-ray detector used to provide the image.

X-ray microscopes are described, for example, wherein mirror optics are used for imaging the specimen on the detector such as a Wolter optic which images the specimen with a grazing incidence of the X-radiation. The quality of the microscopic image generated with such microscopes is however not especially good since considerable imaging errors are associated with the mirror optics. In mirror optics operating with grazing incidence, the image error associated therewith is the so-called angle-tangent error. These image errors limit in principle the possible resolution which can be obtained with the microscope and is pregiven by the aperture of the optics.

X-ray microscopes are known wherein so-called zone plates are utilized for focussing the X-radiation on the specimen as well as for imaging the specimen on the detector. These zone plates make it possible (similar to very thin lenses) to provide an imaging of the object or specimen which is free of image faults and therefore of high resolution. However, the zone plates have a significantly less efficiency than mirror optics. The efficiency in practice lies between 5% and 15%, that is, a maximum of only 15% of the X-radiation impinging on the zone plate is utilized for imaging.

An overview of the various X-ray microscopes is provided in the text of D. Rudolph et al entitled "X-Ray Microscopy", Volume 43 (1984) and published by Springer.

Starting on page 192 of this text, an X-ray microscope is described wherein the condenser as well as the objective are configured as zone plates. The zone plate used as the condenser not only focusses the X-radiation on the object but also functions as a monochromator and separates the monochromatic radiation required for the high resolution imaging from the more or less expanded wavelength range supplied by the X-ray source. This takes place simply by a suitable pin-hole diaphragm on the optical axis which effects the condition that only one of the monochromatic images passes through the diaphragm with the image arising on the optical axis as a consequence of the wavelength dependency of the focal width of the zone plate.

The X-ray microscope described above is relatively light attenuating with the above-mentioned low efficiency because of the use of zone plates so that long exposure times result which can lead to motional blurring during exposure when taking recordings of living cells. For this reason, one is dependent upon the most intensive X-radiation sources.

For the reasons given above, synchroton radiation from electron storage rings is used almost exclusively. However, this brings with it the disadvantage that the X-ray microscope is not self-contained, that is, the user is tied to the few electron storage rings with respect to the measuring time which is available.

So-called plasma focus sources are also known as X-radiation sources. Such X-ray sources are described for example in U.S. Pat. No. 4,596,030 and do not however continuously supply X-radiation; instead, they supply short X-ray pulses which are followed by a relatively long dead time during which the capacitors of the X-radiation sources must be recharged. The X-radiation contained in one pulse is in many cases inadequate.

SUMMARY OF THE INVENTION

From the foregoing, it is seen that a light-intense X-ray microscope which is self-contained while at the same time having high resolution does not exist up to now. However, for biological applications, it is precisely this type of microscope which is required for the investigation of living cells because of the required short exposure times.

The X-ray microscope according to the invention includes the following features: a pulsed X-ray source which supplies an intensive line radiation; a reflecting condenser which focusses the radiation of the radiation source on the specimen to be investigated; and, an X-ray optic configured as a zone plate which images the object with high resolution on the X-ray detector.

By combining the pulsed X-ray source, which supplies intensive line radiation, and a reflecting condenser, the energy which is available is optimally utilized. The use of the mirror optics on the illumination side is not disadvantageous since, on the one hand, the image errors of the reflecting condenser are significantly less critical than on the imaging end of the microscope. In contrast, a 20 to 30 multiple in savings of light is obtained in comparison to a zone plate on the illumination side.

Although the reflecting condenser cannot be used as a monochromator, this is not, however, necessary since X-ray sources such as the plasma focus already supply an adequately intense monochromatic radiation.

In view of the light savings achieved, the zone plate can be retained on the imaging side with its excellent imaging characteristics.

With the combination described above, adequate X-radiation is available for the first time in order to image biological specimens adequately; that is, the X-radiation contained in one X-ray pulse is optimally utilized and is adequate for recording an X-ray image of biological specimens.

For example, the reflecting condenser can be a segment of an ellipsoid which focusses the X-radiation with a grazing incidence on the specimen. It is advantageous to provide the reflecting condenser with a multilayer for increasing the reflective capacity. In this way, the efficiency of the microscope can be again improved.

The zone plate utilized for imaging the specimen on the detector is preferably a phase zone plate which has a higher efficiency than an amplitude zone plate.

It is also advantageous when the condenser images the X-radiation source directly on the specimen in the manner of a so-called critical illumination. In contrast to microscopes which are conventional and utilize a so-called "Köhler illumination", this affords the advantage that a single condenser optic is adequate; that is, the efficiency on the illuminating side is optimized.

It is advantageous when the reflecting condenser is protected by one or more foils through which the radiation beam passes. With this foil, the sensitive mirror surfaces are protected against dust and dirt from the ambient and against vapor from the plasma focus source which would otherwise condense on the optical faces of the condenser and reduce its efficiency.

A photoplate or an X-ray sensitive CCD-camera can be used as a detector. An image memory is preferably connected downstream of the camera into which the images of the specimen to be investigated are read in and further processed with the known methods of image processing. The images stored in this manner are generated with each X-ray pulse.

BRIEF DESCRIPTION OF THE DRAWING

The invention will now be described with respect to the single figure of the drawing which shows the X-ray microscope according to the invention.

DESCRIPTION OF THE PREFERRED EMBODIMENTS OF THE INVENTION

Referring to the drawing, reference numeral 1 identifies the X-ray source in the microscope. This X-ray source is a plasma focus source of the kind described in U.S. Pat. No. 4,596,030 incorporated herein by reference. This plasma focus source supplies a point-shaped plasma for short times. The plasma emits X-radiation at a dominant emission wavelength on the Lyman-$\alpha$ line of six-times ionized nitrogen. The plasma focus source 1 is driven by a capacitor bank 2 which is electrically charged in the time between discharges.

The X-radiation emanating from the plasma focus 1*a* is focussed with the aid of a reflecting condenser 3 on the specimen mounted on a specimen holder 4. The reflecting condenser 3 has the form of a rotational ellipsoid and reflects the X-radiation incident on its mirror surfaces at a grazing incidence. The reflecting condenser 3 is closed off at one or both ends thereof by respective foils 15 and 16 which protect the sensitive mirror surfaces against contamination. The foils are produced from a material such as polyimide which is absorbent as little as possible in the spectral range of the X-radiation.

A so-called microzone plate 5 is mounted above the specimen plane. This microzone plate defines the actual imaging optics of the X-ray microscope. The spacing of the microzone plate 5 from the specimen plane is greatly exaggerated in the schematic. Actually, the microzone plate has a diameter of 20 to 50 $\mu$m and is disposed only a few tenths of a millimeter above the specimen to be investigated.

The microzone plate 5 images the specimen greatly enlarged on a detector 6. The detector 6 is a solid-state camera in the form of a CCD-camera such as a camera having the product number NXA 1011 of the Valvo company which is a corporation doing business in Germany. The detector 6 is sensitized for the X-radiation in that the cover glass is removed and the photosensitive surface is covered with a fluorescence colorant such as $Gd_2O_2S$:Tb.

The CCD-camera 6 is mounted on a carrier 7 which can be displaced along the optical axis as indicated by the arrow with the aid of an adjusting device 8 for the purpose of focussing or magnification changing. The focussing itself is preferably done by changing the distance between the microzone plate and the specimen.

The components of the X-ray microscope described above are arranged in a cylindrical column 9 mounted on the capacitor bank 2. The column 9 is at a vacuum and the space around the specimen stage 4 can be filled with a gas such as helium or hydrogen which is only slightly absorbent in the range of the X-radiation used and the space is separated from the vacuum system by means of two X-ray transparent foils (not shown).

The signal lines of the CCD-camera 6 are passed through the adjusting device 8 and are connected to an electronic unit 10 which reads out the image of the CCD-camera 6. This camera electronic unit 10 is synchronized via a control unit 11 with the electronics (not shown) for the operation of the plasma focus source in such a manner that after each X-ray pulse supplied by the plasma focus source 1, an image is taken in and stored in an image memory 13. The images stored there can be viewed by means of a monitor 12 likewise connected to the electronic unit 10.

Variations from the configuration described herein are within the scope of the invention. Accordingly, an X-ray film cassette can be used in lieu of the CCD-camera 6. In addition, other mirror optics can be used in lieu of the reflecting condenser in the form of a rotation ellipsoid operating at grazing incidence. An example of such other mirror optic is a mirror arrangement of the so-called Schwarzschild type which is described, for example, on page 566 of the reference text of K. Mütze et al entitled "ABC der Optik", published by Werner Dausien (1972).

It is understood that the foregoing description is that of the preferred embodiments of the invention and that various changes and modifications may be made thereto without departing from the spirit and scope of the invention as defined in the appended claims.

What is claimed is:

1. An X-ray microscope for investigating a specimen, the X-ray microscope comprising:

a pulsed X-ray radiation source for supplying an intensive line radiation and defining an optical axis along which the line radiation travels;

reflecting condenser means for focussing the radiation on the specimen;

an X-ray detector mounted on said axis downstream of said reflecting condenser means; and, zone plate means for imaging the specimen on said detector with high resolution.

2. The X-ray microscope of claim 1, said reflecting condenser means including a reflecting condenser defining a reflective surface; and, a multiple layer disposed on said surface for increasing reflectivity.

3. The X-ray microscope of claim 2, said reflecting condenser being configured to focus said X-radiation onto the specimen at grazing incidence to ensure total reflection.

4. The X-ray microscope of claim 2, said reflecting condenser being a segment of an ellipsoid.

5. The X-ray microscope of claim 1, said X-ray source being a plasma-focus source.

6. The X-ray microscope of claim 1, said zone plate means being a phase zone plate.

7. The X-ray microscope of claim 1, further comprising foil means for protecting said reflecting condenser means and being permeable to said radiation.

8. The X-ray microscope of claim 1, said reflecting condenser means being adapted to image said source into the specimen.

9. The X-ray microscope of claim 1, said X-ray detector being a semiconductor camera.

10. The X-ray microscope of claim 1, further comprising electronic means for synchronizing said detector and said X-ray source so as to cause an image to be read out of said detector after a pulse of said radiation.

11. A method of generating microscopic images of high resolution in the light of X-radiation, the method comprising the steps of:

focussing the radiation of a pulsed X-ray radiation source on a specimen by means of a reflecting condenser;

generating an image of the specimen with a triggered pulse of X-radiation;

imaging the specimen on a camera with a zone plate; and, reading out the camera synchronously with the pulsed X-ray radiation source after a generated pulse of said radiation.

* * * * *

UNITED STATES PATENT AND TRADEMARK OFFICE

CERTIFICATE OF CORRECTION

PATENT NO. : 5,222,113

DATED : June 22, 1993

INVENTOR(S) : Jürgen Thieme, Bastian Niemann, Günther Schmahl and Dietbert Rudolph

It is certified that error appears in the above-identified patent and that said Letters Patent is hereby corrected as shown below:

On the title page, under "Inventors", item [75]: delete "Bastian Nieman" and substitute -- Bastian Niemann -- therefor.

On the title page, under "Inventors", item [75]: delete "Nordheim" and substitute -- Einbeck-Wenzen -- therefor.

Signed and Sealed this

Fifteenth Day of March, 1994

*Attest:*

Bruce Lehman

BRUCE LEHMAN

*Attesting Officer*

*Commissioner of Patents and Trademarks*